US008485959B2

(12) United States Patent
Madsen et al.

(10) Patent No.: US 8,485,959 B2
(45) Date of Patent: Jul. 16, 2013

(54) CENTRIFUGAL SEPARATOR AND A LIQUID PHASE DISCHARGE PORT MEMBER

(75) Inventors: Bent Madsen, Gentofte (DK); Klaus Dircks, Copenhagen K (DK)

(73) Assignee: Alfa Laval Corporate AB, Lund (SE)

( * ) Notice: Subject to any disclaimer, the term of this patent is extended or adjusted under 35 U.S.C. 154(b) by 851 days.

(21) Appl. No.: 12/599,106

(22) PCT Filed: May 8, 2008

(86) PCT No.: PCT/DK2008/050102

§ 371 (c)(1),
(2), (4) Date: Dec. 30, 2009

(87) PCT Pub. No.: WO2008/138345

PCT Pub. Date: Nov. 20, 2008

(65) Prior Publication Data

US 2010/0167901 A1 Jul. 1, 2010

(30) Foreign Application Priority Data

May 9, 2007 (DK) ..... 2007 00697

(51) Int. Cl.
*B04B 11/02* (2006.01)
*B04B 1/20* (2006.01)

(52) U.S. Cl.
USPC ..... 494/56; 494/53

(58) Field of Classification Search
USPC ..... 494/53, 54, 56, 57, 60; 210/380.1, 210/380.3
See application file for complete search history.

(56) References Cited

U.S. PATENT DOCUMENTS

| | | | | |
|---|---|---|---|---|
| 3,580,492 | A * | 5/1971 | Schnittger et al. | 494/53 |
| 4,575,370 | A | 3/1986 | LaMontagne | |
| 5,147,277 | A | 9/1992 | Shapiro | |
| 5,217,428 | A * | 6/1993 | Schlip et al. | 494/56 |

(Continued)

FOREIGN PATENT DOCUMENTS

| | | | |
|---|---|---|---|
| CA | 2473640 | | 8/2003 |
| DE | 3822983 | A1 * | 1/1990 |

(Continued)

OTHER PUBLICATIONS

Notice of Reason for Rejection issued in corresponding Japanese Patent Application No. 2010-506804 dated Jan. 20, 2012.

*Primary Examiner* — Charles E Cooley
(74) *Attorney, Agent, or Firm* — MKG, LLC

(57) ABSTRACT

A centrifugal separator comprises a bowl rotating in use around an axis of rotation. The axis of rotation extends in a longitudinal direction, and a radial direction extends perpendicular to the longitudinal direction. A base plate provided at one longitudinal end of the bowl, said base plate having an internal and external side, an outlet opening being provided in the base plate. A casing is projecting at the outlet opening on the external side of said base plate, said casing comprising a casing side, a normal to said casing side extending at an acute angle relative to a circumferential direction of the bowl at said casing and a discharge opening is provided in said casing side. The discharge opening is radially outwardly limited by a weir with an overflow edge and said discharge opening extending radially inwardly to a position above a highest intended level of liquid in the bowl.

18 Claims, 5 Drawing Sheets

U.S. PATENT DOCUMENTS

| | | | | |
|---|---|---|---|---|
| 7,022,061 | B2 * | 4/2006 | Leung et al. | 494/56 |
| 7,753,834 | B2 * | 7/2010 | Figgener et al. | 494/53 |
| 8,157,716 | B2 * | 4/2012 | Madsen | 494/56 |
| 2004/0072667 | A1 * | 4/2004 | Leung et al. | 494/56 |
| 2004/0072668 | A1 * | 4/2004 | Leung | 494/56 |
| 2010/0167901 | A1 * | 7/2010 | Madsen et al. | 494/60 |
| 2011/0143906 | A1 * | 6/2011 | Geehan et al. | 494/56 |

FOREIGN PATENT DOCUMENTS

| | | | |
|---|---|---|---|
| JP | 61167468 | A | 7/1986 |
| JP | 61278370 | A | 12/1986 |
| JP | 11179236 | | 7/1999 |
| JP | 11197547 | | 7/1999 |
| WO | 03064054 | | 8/2003 |

* cited by examiner

CENTRIFUGAL SEPARATOR AND A LIQUID PHASE DISCHARGE PORT MEMBER

FIELD OF THE INVENTION

The present invention relates to a centrifugal separator comprising a bowl rotatable about an axis of rotation, said axis of rotation extending in a longitudinal direction of said bowl, a base plate provided at one longitudinal end of said bowl, said base plate having an internal side and an external side, an outlet opening provided in said base plate, a casing projecting at the outlet opening on the external side of said base plate, said casing comprising a casing side, a normal to said casing side extending at an acute angle to a circumferential direction of the bowl at said casing and a discharge opening being provided in said casing side.

BACKGROUND OF THE INVENTION

US 2004072668 describes a centrifugal separator having a casing with a nozzle provided in the casing side. Above the casing, i.e. closer the longitudinal axis, a weir may be provided. The depth of a pool of liquid in the bowl is determined by the diameter of the nozzle provided that the rate of feed to the separator is constant.

U.S. Pat. No. 7,022,061 describes a centrifugal separator that includes a liquid phase discharge port having a tubular member with an elbow bend.

U.S. Pat. No. 4,575,370 discloses a centrifugal separator having a bowl with a base plate and liquid phase outlet openings provided in said base plate. The outlet openings are partly covered by weir plates to adjust the level of liquid or depth of a pool of liquid in the bowl. Generally, the use of a weir ensures that the level of liquid in the bowl substantially cannot exceed the level of the weir, because the area of the opening above the weir from a practical view is unlimited. According to U.S. Pat. No. 4,575,370 a notch is provided in the overflow edge of the weir or a through hole is provided in the weir to make it possible, in a start-up phase of running the separator, to obtain operation with a lower liquid level at a smaller rate of feed to the separator.

A problem in such a centrifugal separator is that liquid flowing over the overflow edge of the weir plate tends to cling to the outside of the base plate thereby being accelerated which is energy consuming thus causing energy loss and therefore an extra power consumption of up to 15%. Further, on entry into the bowl the feed is accelerated to a rotational speed and the energy thus consumed is lost when the liquid phase exits over a weir at the outlets in the base plate.

The separator of the above-mentioned US 2004072668 seeks to solve this problem. However the use of a nozzle with a given diameter entails that at a varying feed rate the level of liquid in the bowl will also vary.

SUMMARY OF THE INVENTION

According to a first aspect of the invention a centrifugal separator is provided wherein a discharge opening is radially outwardly limited by a weir with an overflow edge and said discharge opening extending radially inwardly to a position above a highest intended level of liquid in the bowl.

Placing the weir at the discharge opening ensures that the level of liquid in the bowl is maintained substantially constant at all feed rates since the discharged liquid simply flows over the top of the weir plate, the weir plate thus determining the level of liquid in the casing and thereby the bowl. Moving the discharge opening and the weir away from the outlet opening ensures that no liquid will cling to the outside of the base plate. Thereby a loss of energy that can be in the range of 10% to 15% may be avoided. Further energy of the rotating liquid can be regained at the discharge opening, resulting in a power gain that can be in the range of 10% to 15%, when the liquid is discharged in the opposite direction relative to the direction of rotation.

Normally several outlets are provided in the base plate placed substantially equidistantly on a common radius.

According to a preferred embodiment of the invention the acute angle is in the range between about 0° and about 60°, preferably between about 5° and about 35°, and more preferably between about 15° and about 30°. An acute angle of 0° or close to 0° will provide the largest regain of energy. However in case a plurality of outlets with casings projecting from the base plate of the bowl is provided an angle of 0° may result in liquid discharged from one outlet colliding with an adjacent casing projecting from the base plate of the bowl. This is avoided by providing a larger angle. In case of only a few e.g. two outlets the problem of collision does not exist.

According to an embodiment of the invention the weir comprises a hole. The hole prevents liquid from flowing out of the bowl through the solid discharge opening during the start-up period by providing a liquid outlet effective at start-up conditions with a low feed rate to provide a low level of liquid in the bowl.

According to a preferred embodiment of the invention the weir is provided as an exchangeable weir plate, whereby the level of the overflow edge may be changed to correspond to the desired level of liquid in the bowl. According to a further preferred embodiment of the invention grooves are provided at said discharge opening, which are adapted to receive said weir plate. Hereby the process of exchanging the weir plate is facilitated considerably, and correct installation of the weir plate is ensured at all times.

According to another preferred embodiment of the invention the casing comprises a curved wall extending from the base plate to a remote side of said casing side, a side of the discharge opening being flush with the curved wall. Such a configuration provides an internal surface of the casing that causes little turbulence in the discharged liquid, thereby further reducing the power consumption.

According to a further preferred embodiment of the invention said curved wall and said casing side meet at substantially right angles.

According to a second aspect of the invention a liquid phase discharge port member is adapted to be placed over an outlet opening of a bowl of a centrifugal separator, comprising a flange, an inlet opening provided in said flange, a casing projecting at the inlet opening on a side of said flange, said casing comprising a casing side, a normal to said casing side extending at an acute angle relative to said flange, and a discharge opening provided in said casing side, which liquid phase discharge port is characterized in said discharge opening being limited by a weir with an overflow edge.

With a liquid phase discharge port member according to the invention it is possible to adapt an existing centrifugal separator to achieve the abovementioned advantages simply by attaching a liquid phase discharge port member according to the invention over the liquid phase outlet ports of the separator.

Preferably the flange of the liquid phase discharge port member comprises holes adapted to receive fastening means such as bolts.

BRIEF DESCRIPTION OF THE DRAWINGS

The invention will now be described in further detail based on a non-limiting exemplary embodiment, and with reference to the drawings. In the drawings.

DETAILED DESCRIPTION

Figure 1:
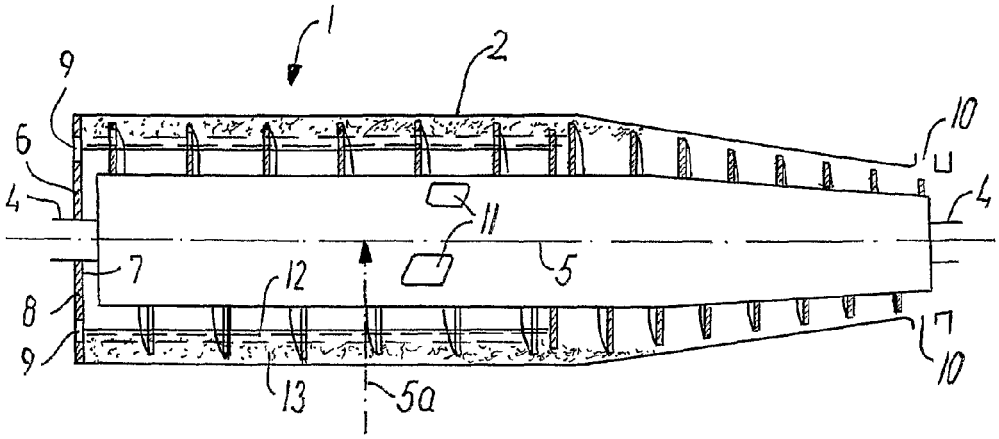
FIG.1 PRIOR ART
FIG. 1 shows a schematic view of a prior art centrifugal separator.

A prior art centrifugal separator 1 shown in FIG. 1 comprises a bowl 2 and a screw conveyor 3 which are mounted on a shaft 4 such that in use they can be brought to rotate around an axis 5, the axis of rotation 5 extending in a longitudinal direction of the bowl 2. Further, the centrifugal separator 1 has a radial direction 5*a* extending substantially perpendicular to the longitudinal direction.

For the sake of simplicity directions "up" and "down" are used herein as referring to a radial direction towards the axis of rotation 5 and away from the axis of rotation, respectively.

The bowl 2 comprises a base plate 6 provided at one longitudinal end of the bowl 2, which base plate 6 has an internal side 7 and an external side 8. The base plate 6 is provided with a number of liquid phase outlet openings 9. Furthermore the bowl 2 is at an end opposite to the base plate 6 provided with solid phase discharge openings 10.

Further the screw conveyor 3 comprises inlet openings 11 for feeding e.g. a slurry to the centrifugal separator 1, the slurry comprising a light or liquid phase 12 and a heavy or solid phase 13. During rotation of the centrifugal separator 1 as previously described, separation of the liquid 12 and solid 13 phases is obtained. The liquid phase 12 is discharged through the outlet openings 9 in the base plate 6, while the screw conveyor 3 transports the solid phase 13 towards the solid phase discharge openings 10 through which the solid phase 13 is eventually discharged.

Figure 2:
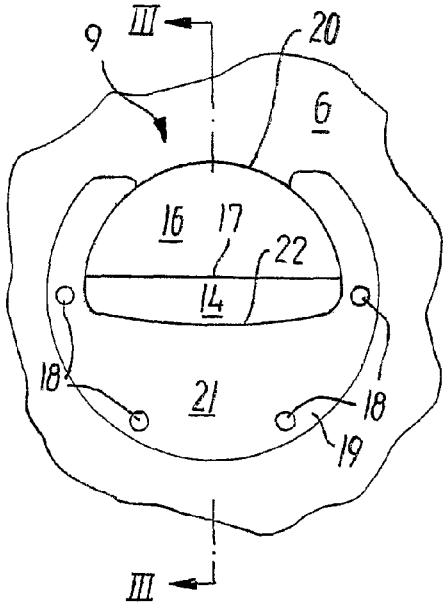
FIG.2 PRIOR ART
FIG. 2 shows a front view of a prior art outlet opening of the centrifugal separator, the outlet opening being provided with a weir plate.

With reference to FIG. 2 each liquid phase outlet opening 9 may according to the prior art be partly covered by a weir plate 14. The weir plate 14 determines the level 15 of liquid (cf. FIG. 3) in the bowl which substantially cannot exceed the overflow edge 17 of the weir plate, because the area 16 of the opening above the weir plate 14 from a practical view of the liquid is unlimited. The weir plate 14 is securely fixed to the base plate 6 by fastening means (not shown) in the form of e.g. bolts protruding through holes 18 in a peripheral part 19 of a supporting device 21. In the fixed state the peripheral part 19 covers at least part of the rim 20 of the liquid phase outlet opening 9, and the supporting device 21 partly covers the weir plate 14 to a level indicated by 22 on FIG. 2.

Figure 3:
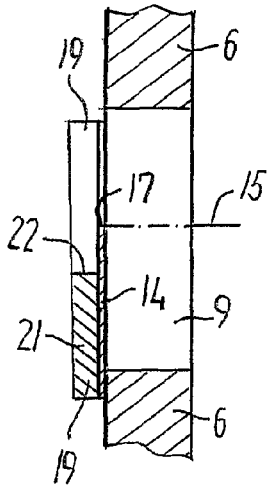
FIG.3 PRIOR ART
FIG. 3 shows a section along line III-III in FIG. 2.

FIG. 3 shows a cross section through the liquid phase outlet opening 9 along the line III-III in FIG. 2, indicating the level 15 of liquid, which substantially coincides with the overflow edge 17 of the weir plate 14.

A problem in the prior art relates to liquid flowing over the overflow edge 17 of the weir plate tending to cling to the outer surface of the base plate 6 by getting caught by the supporting device 21 which causes extra power consumption.

To overcome this disadvantage, the centrifugal separator 1 may according to the invention be provided with liquid phase discharge port members placed over an outlet opening 9 of a bowl 2 of the centrifugal separator 1 instead of the weir plate 14 and its supporting device 21.

One embodiment of a liquid phase discharge port member 30 is shown seen from different angles in FIGS. 4 to 8, and will thus be explained below as an exemplary but in no way limiting embodiment of the invention.

Figure 5:
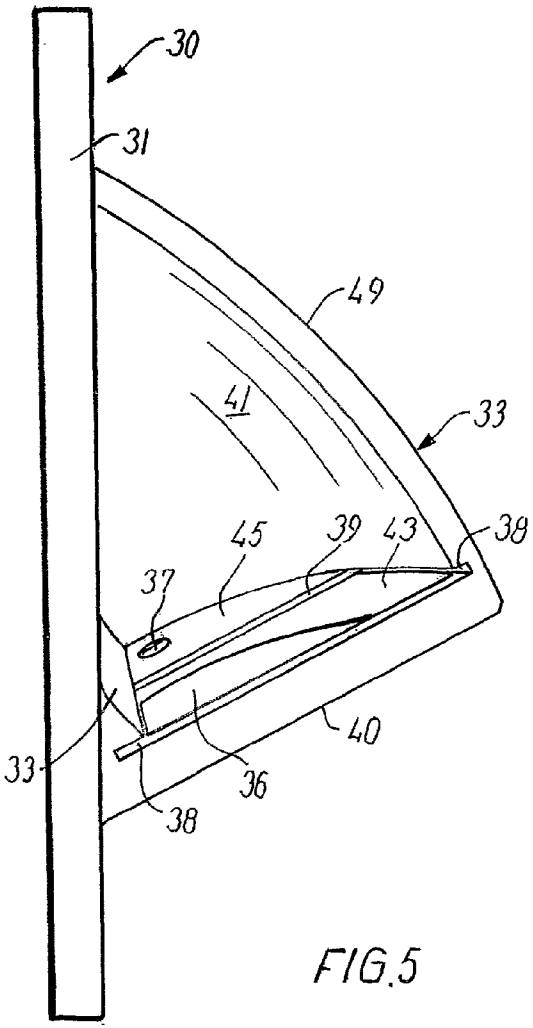
FIG. 5 shows a perspective top view of the liquid phase discharge port member according to FIG. 4.
Figure 4:
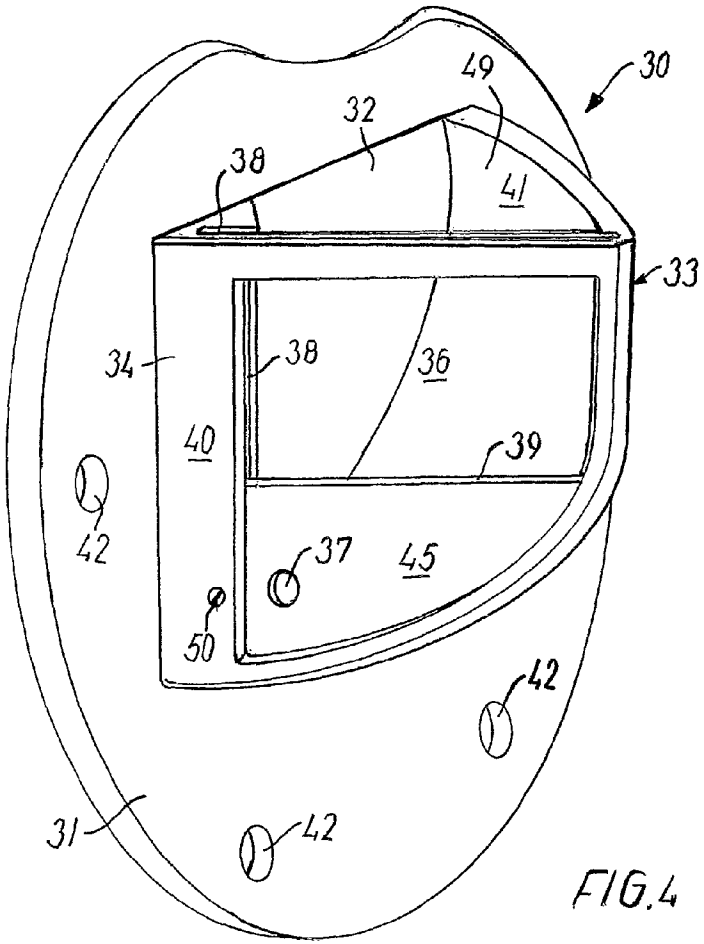
FIG. 4 shows a perspective view of a liquid phase discharge port member according to the invention.
Figure 6:
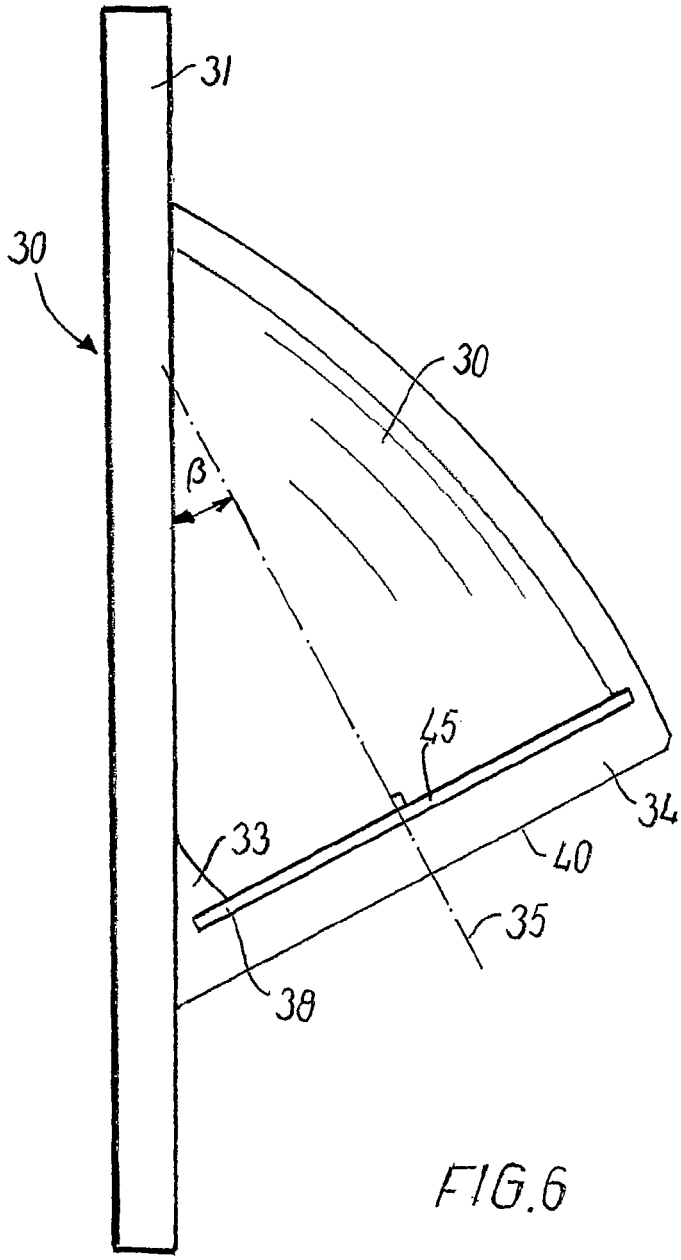
FIG. 6 shows a top view of the liquid phase discharge port member.

With reference to FIGS. 4 and 5 in particular the liquid phase discharge port member 30 comprises a flange 31 in which is provided an inlet opening 32 (best seen in FIG. 8) and a casing 33 projecting at the inlet opening 32 on a side of the flange 31. The casing 33 comprises a casing side 34, where a normal 35 (shown on FIG. 6) to the casing side 34 extends at an acute angle β (likewise shown on FIG. 6) relative to the flange 31. In the casing side 34 is provided a discharge opening 36, which is limited by a weir constituted by a weir plate 45 with an overflow edge 39.

In a mounted position the overflow edge 39 has a substantially constant distance to the rotational axis 5 of the centrifugal separator 1. This is indicated by a radius 46 in FIG. 7, said radius 46 being perpendicular to the overflow edge 39 and said radius comprising an arrow 47 pointing towards the axis of rotation of the centrifugal separator.

With this configuration the level of liquid in the bowl 2 of the centrifugal separator 1 is determined by the level of the overflow edge 39 of the weir plate 45. Hence the level of liquid in the bowl 2 may be maintained substantially constant at all feed rates.

The abovementioned acute angle β can be in the range between about 0° and about 60°, preferably between about 5° and about 35°, and more preferably between about 15° and about 30°, e.g. approximately 25° as shown.

In the embodiment shown the liquid phase discharge port member 30 comprises a hole 37 that provides an extra liquid outlet below the overflow edge 39. This extra liquid outlet may provide for running the centrifugal separator with a low level of liquid in the bowl 2 during a start-up phase.

The weir plate 45 is in the illustrated embodiment exchangeable, and for the purpose of easy exchange of the weir plate 45 grooves 38 are provided at the discharge opening 36, which grooves 38 are adapted to receive the weir plate 45, which is secured by a screw 50. With this configuration the level of the overflow edge 39 may in a simple way be changed to correspond to a desired level of liquid in the bowl 2.

In the figures the casing side 34 is shown as comprising an upper transverse section 44. However, the purpose of this upper transverse section 44 is only to brace the casing 33, and it may therefore be omitted if the strength of the casing 33 and the rest of the casing side 34 is sufficient to withstand the pressure form the discharged liquid by itself without deforming.

The casing 33 comprises a curved wall 49 extending from the flange 31 to a remote side 40 of the casing side 34, where a side 43 of the discharge opening 36 is flush with the curved wall 49. This configuration provides for an internal surface 41 of the casing causing little or no turbulence in the discharged liquid. The curved wall 49 and the casing side 34 meet at substantially right angles.

Furthermore through holes 42 are provided in the flange 31. The through holes 42 may be used to secure the liquid phase discharge port member 30 to the base plate 6 of the centrifugal separator 1 by the use of fastening means (not shown) such as bolts or the like.

The top of the casing is open in the embodiment shown. The casing might be closed by a top wall, but as the liquid phase leaving the bowl 2 through the outlet openings 9 will flow out through the lower part of the discharge opening 36 right above the overflow edge 39 without filling out the upper part of the discharge opening 36, such a top wall would be superfluous, at least from a flow point-of-view.

In an alternative embodiment of the present invention the casing is integral with the base plate of the centrifugal separator instead of being attached thereto by means of the flange 31. By comparison with the embodiment described above the outlet openings of the base plate would in such alternative embodiment be identical with the inlet openings of the casings.

Figure 7:
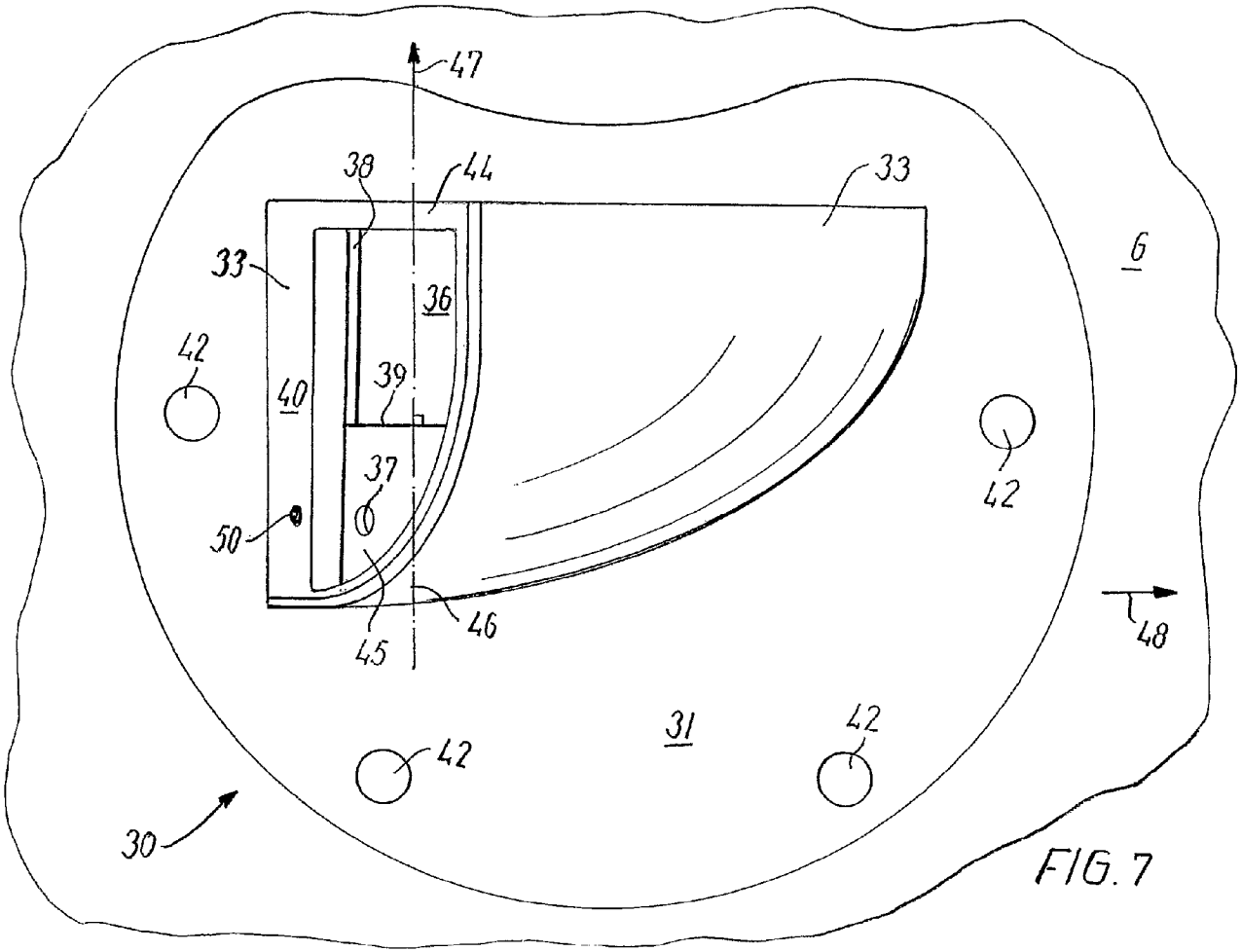
FIG. 7 shows a front view of a liquid phase discharge port member positioned on a base plate of a centrifugal separator.
Figure 8:
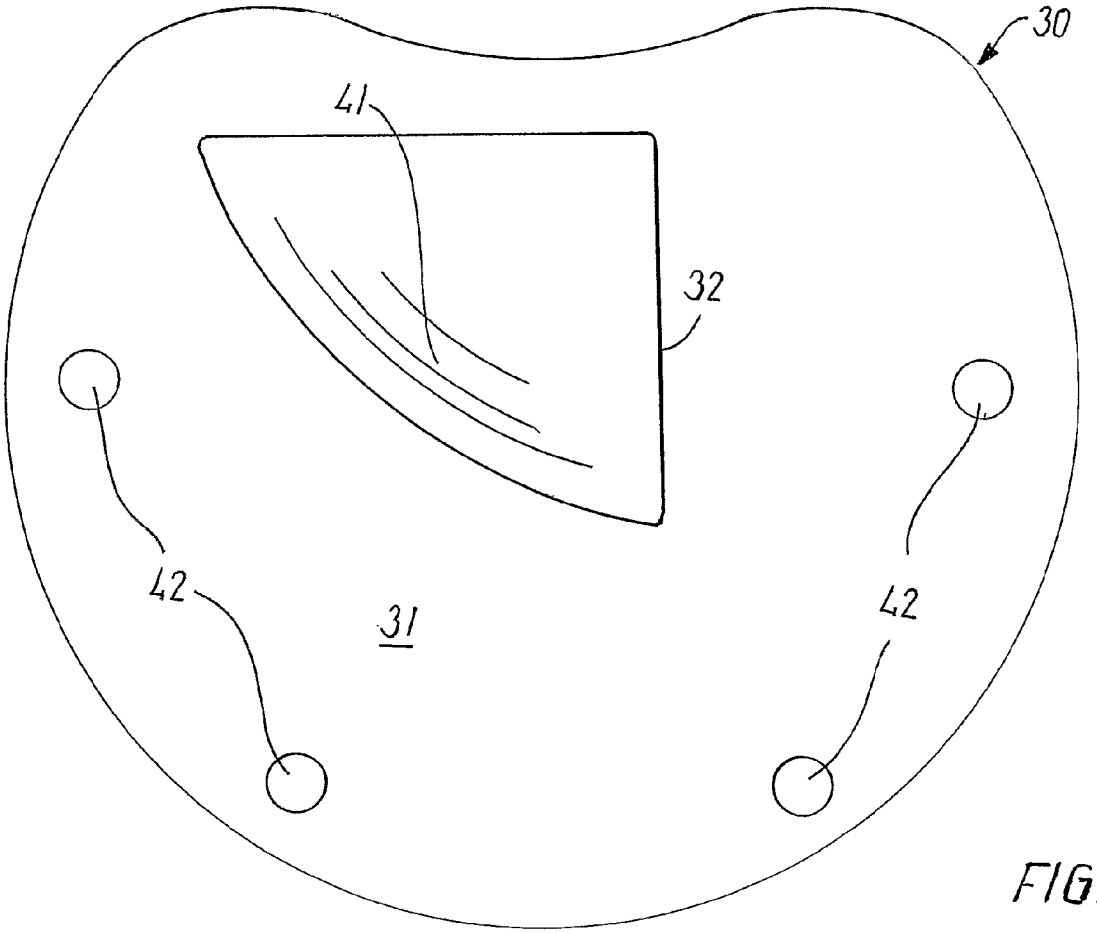
FIG. 8 shows a rear view of the liquid phase discharge port member.

A centrifugal separator equipped with liquid phase discharge port members 30 works as follows:

The bowl 2 and the screw conveyor 3 is brought to rotate around their common axis 5 of rotation in the same direction but at different speeds of rotation. A substance containing a liquid phase 12 and a solid phase 13 is fed into the bowl through the inlet openings 11. The solid phase 13 will be separated form the liquid phase 12 and due to the difference in rotational speeds be brought towards the solid phase discharge openings 10. At the same time the liquid phase is flowing towards the outlet openings 9 in the base plate 6, and there discharged through the liquid phase discharge port members 30. Due to the rotation of the bowl 2 the liquid phase discharge port members 30 will move in the direction indicated by arrow 48 (FIG. 7).

It should be noted that for a centrifuge having the opposite direction of rotation the liquid phase discharge port member should be mirror-inverted relative to the radius.

The discharge openings 36 of the liquid phase discharge port members 30 are placed so that they face rearwards as compared to the direction of rotation 48, whereby the liquid phase is discharged in a substantially circumferential direction opposite to the direction of rotation.

The liquid phase fills the lower part of the casing 33 and flows over the overflow edge 39. The curved shape of the casing 33 and the flush transition between casing 33 and casing side 34 ensures a smooth flow of liquid through the casing 33, whereby the liquid leaves the casing in the direction of the normal 35.

The liquid phase is subsequently discharged through the discharge opening 36 with a flow profile raising slightly above the overflow edge 39. In the start-up phase where the level 15 of liquid lies below the overflow edge 39, the liquid phase may be discharged through a hole 37 in the weir plate as described above. At full rate operation between 30% and 70% e.g. about 50% of the liquid phase may be discharged through the hole(s) 37. Depending on the feed to be processed in the centrifuge it may be preferred to provide only some weir plates with holes. Thereby fewer larger holes with less tendency to clog-up may be provides, said fewer larger holes having together the same capacity as smaller holes provided in each weir plate.

The orientation of the weir plate 45 and thereby the overflow edge 39 in the acute angle β (cf. FIG. 6) together with its position in the casing 33, whereby it is raised from the base plate 6, ensures that as the liquid flows over the overflow edge it will neither cling to the outside of the base plate 6 of the bowl 2, nor interfere with adjacent liquid phase discharge port members 30 placed at adjacent outlet openings 9 in the base plate 6, but merely be discharged with substantially little or no residues left on the base plate 6 or liquid phase discharge port members 30.

The overflow edge 39 ensures a substantially constant level of liquid in the bowl 2 even at varying feed rates.

It should be noted that the above description of preferred embodiments is merely an example, and that the skilled person would know that numerous variations are possible without departing from the scope of the claims. In case of a centrifuge separating e.g. two liquid phases it is possible to use liquid phase discharge port members according to the present invention at the outlets for one of the liquid phases only or for both.

What is claimed is:

1. A centrifugal separator comprising:

a bowl rotatable about an axis of rotation, said axis of rotation extending in a longitudinal direction of said bowl, a base plate provided at one longitudinal end of said bowl, said base plate having an internal side and an external side;

an outlet opening provided in said base plate;

a casing projecting at the outlet opening on the external side of said base plate, said casing comprises a casing side, where a normal to said casing side extends at an acute angle (β) relative to a circumferential direction of the bowl at said casing;

a discharge opening provided in said casing side; and wherein said discharge opening is radially outwardly limited by a weir with an overflow edge and said discharge opening extending radially inwardly to a position above a highest intended level of liquid in the bowl.

2. A centrifugal separator as claimed in claim 1, wherein said acute angle is between about 0° and about 60°.

3. A centrifugal separator as claimed in claim 1, wherein said weir comprises a hole.

4. A centrifugal separator as claimed in claim 1, wherein said weir is provided by an exchangeable weir plate.

5. A centrifugal separator as claimed in claim 4, wherein grooves provided at said discharge opening are adapted to receive said weir plate.

6. A centrifugal separator as claimed in claim 1, wherein said casing comprises a curved wall extending from the base plate to a remote side of said casing side, a side of the discharge opening being substantially flush with the curved wall.

7. A centrifugal separator as claimed in claim 6, wherein said curved wall and said casing side meet at substantially right angles.

8. A centrifugal separator as claimed in claim 1, wherein said acute angle is in the range between about 5° and about 35°.

9. A centrifugal separator as claimed in claim 1, wherein said acute angle is in the range between about 15° and about 30°.

10. A liquid phase discharge port member adapted to be placed over an outlet opening of a bowl of a centrifugal separator, comprising:

a flange;

an inlet opening provided in said flange;

a casing projecting at the inlet opening on a side of said flange, said casing comprises a casing side, where a normal to said casing side extends at an acute angle (β) relative to said flange;

a discharge opening provided in said casing side; and wherein said discharge opening is limited by a weir with an overflow edge.

11. A liquid phase discharge port member as claimed in claim 10, wherein said acute angle is in the range between about 0° and about 60°.

12. A liquid phase discharge port member as claimed in claim 10, wherein said weir comprises a hole.

13. A liquid phase discharge port member as claimed in claim 10, wherein said weir is provided by an exchangeable weir plate.

14. A liquid phase discharge port member as claimed in claim 13, wherein grooves provided at said discharge opening are adapted to receive said weir plate.

15. A liquid phase discharge port member as claimed in claim 10, wherein said casing comprises a curved wall extending from the flange to a remote side of said casing side, a side of the discharge opening being flush with the curved wall.

16. A liquid phase discharge port member as claimed in claim 15, wherein said curved wall and said casing side meet at substantially right angles.

17. A liquid phase discharge port member as claimed in claim 10, wherein said acute angle is in the range between about 5° and about 35°.

18. A liquid phase discharge port member as claimed in claim 10, wherein said acute angle is in the range between about 15° and about 30°.

* * * * *